US007966946B1

(12) United States Patent
Novak et al.

(10) Patent No.: US 7,966,946 B1
(45) Date of Patent: Jun. 28, 2011

(54) RAILWAY TRUCK PEDESTAL BEARING ADAPTER

(75) Inventors: Jennifer Novak, St. Louis, MO (US); Matthew Skibinski, Alton, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 0 days.

(21) Appl. No.: 12/925,350

(22) Filed: Oct. 21, 2010

(51) Int. Cl.
*B61F 5/26* (2006.01)

(52) U.S. Cl. ..... 105/218.1; 105/224.1; 105/219; 105/220

(58) Field of Classification Search ..... 105/218.1, 105/219, 220, 224.1, 225
See application file for complete search history.

(56) References Cited

U.S. PATENT DOCUMENTS

| | | | | |
|---|---|---|---|---|
| 3,381,629 | A * | 5/1968 | Jones | 105/218.1 |
| 3,699,897 | A * | 10/1972 | Sherrick | 105/218.1 |
| 3,785,298 | A * | 1/1974 | Reynolds | 105/218.1 |
| 5,081,935 | A * | 1/1992 | Pavlick | 105/224.1 |
| 5,261,332 | A * | 11/1993 | Grandy | 105/218.1 |
| 5,404,826 | A * | 4/1995 | Rudibaugh et al. | 105/222 |
| 5,562,045 | A * | 10/1996 | Rudibaugh et al. | 105/224.1 |
| 5,794,538 | A * | 8/1998 | Pitchford | 105/218.1 |
| 5,799,582 | A * | 9/1998 | Rudibaugh et al. | 105/222 |
| 7,308,855 | B2 * | 12/2007 | Van Auken | 105/218.1 |
| 7,387,074 | B2 * | 6/2008 | Myers | 105/224.1 |
| 7,497,169 | B2 * | 3/2009 | Forbes et al. | 105/218.1 |
| 7,513,199 | B2 * | 4/2009 | Van Auken | 105/218.1 |
| 2005/0268813 | A1 * | 12/2005 | Van Auken | 105/218.1 |
| 2007/0084377 | A1 * | 4/2007 | Myers | 105/218.1 |
| 2008/0066641 | A1 * | 3/2008 | Forbes et al. | 105/224.1 |
| 2008/0271633 | A1 * | 11/2008 | Forbes et al. | 105/218.1 |
| 2010/0064930 | A1 * | 3/2010 | Schorr et al. | 105/224.1 |
| 2010/0288157 | A1 * | 11/2010 | LeFebvre et al. | 105/218.1 |

* cited by examiner

*Primary Examiner* — S. Joseph Morano
*Assistant Examiner* — Jason C Smith
(74) *Attorney, Agent, or Firm* — Edward J. Brosius

(57) ABSTRACT

A railway car truck includes side frames each having a pedestal formed on longitudinally opposite ends thereof. Each pedestal has an upper jaw and a lower jaw surrounding a pedestal opening. The upper jaw has a roof section above the pedestal opening and the lower jaw has an inner wall and an outer wall on opposite sides of the pedestal opening. The inner and outer walls are spaced apart from one another to define a wide pedestal opening. A bearing adapter is received in each pedestal opening. Each bearing adapter includes a concave opening to receive a bearing and a generally rectangular center section having a top surface generally opposite the concave opening. The bearing adapter has steps extending outward from sides thereof that have outer surfaces separated by a distance corresponding to the width of the pedestal opening. The railway car truck also includes an elastomeric adapter pad mounted on top of the bearing adapter that has a generally flat, generally rectangular top section and depending legs that extend along the outer surfaces of the steps. The top section defines a pad for engaging the roof section. The depending legs define pads for engaging the inner and outer walls.

18 Claims, 5 Drawing Sheets

RAILWAY TRUCK PEDESTAL BEARING ADAPTER

BACKGROUND OF THE INVENTION

The subject matter herein relates to a railway freight car truck and, more particularly, to pedestal bearing adapters for use in a pedestal jaw opening of a side frame of the railway freight car truck.

In a railway freight car truck, two axles are held in a pair of laterally spaced side frames, with a bolster extending laterally between and supported on each side frame. The wheels are press fit on the axles, with the ends of the axles also fitted with a roller bearing assembly. The roller bearing assembly is fit into a bearing adapter that is fit into a pedestal jaw opening at the longitudinal end of each side frame. The ends of the bolsters are supported on spring groups, which are supported on the lower portion of the center openings of the side frames.

Bearing adapters and corresponding adapter pads useful in the fitting of the bearing assembly into the pedestal jaw opening of each side frame are known. The bearing adapter is fit on top of the bearing assembly. The adapter pad is fitted on top of the bearing adapter between the bearing adapter and the side frame. However, such known bearing adapters are designed for use with a particular type of side frame. Problems exist when trying to use such bearing adapters and adapter pads with side frames that have a wide pedestal design. Such wide pedestals are widened longitudinally and have a wider jaw opening. However, such added width makes known bearing adapters and adapter pads unusable with such wide pedestal frames, because the bearing adapters and adapter pads may move within the pedestal jaw.

Accordingly, a need remains for a bearing adapter and pad assembly for side frames that have wide pedestals.

BRIEF DESCRIPTION OF THE INVENTION

In an exemplary embodiment, a railway car truck is provided that includes a bolster having laterally opposite ends and two side frames transverse to the bolster and supporting the opposite ends of the bolster. Each side frame has a pedestal formed on longitudinally opposite ends thereof. Each pedestal has an upper jaw and a lower jaw surrounding a pedestal opening. The upper jaw has a roof section above the pedestal opening and the lower jaw has an inner wall and an outer wall on opposite sides of the pedestal opening. The inner and outer walls are spaced apart from one another to define a wide pedestal opening. A bearing adapter is received in each pedestal opening. Each bearing adapter includes a concave opening to receive a bearing and a generally rectangular center section having a top surface generally opposite the concave opening. The bearing adapter includes edge supports extending from the top surface that define an upper jaw pocket therebetween that receives the upper jaw. The bearing adapter includes adapter shoulders at opposite ends of the bearing adapter that define lower jaw pockets at the opposite ends that receives the lower jaw. The bearing adapter has steps extending outward from sides thereof that have outer surfaces separated by a distance corresponding to the width of the pedestal opening. The railway car truck also includes an elastomeric adapter pad mounted on top of the bearing adapter that has a generally flat, generally rectangular top section and depending legs that extend along the outer surfaces of the steps. The top section defines a pad for engaging the roof section. The depending legs define pads for engaging the inner and outer walls. Optionally, the adapter pad may include at least two wear tabs extending laterally outwardly from the top section, where each wear tab has a top face located at a height below the height of the top section.

Optionally, the sides of the bearing adapter may each include an inner step extending downward from the top surface of the bearing adapter and a transition extending outward from the inner step to an outer step, where the outer step has a substantially vertical face extending downward from the transition. The outer step may define the outer surface of the bearing adapter. The steps may be stepped outward at a lower portion thereof to provide additional width for the bearing adapter. Optionally, the legs of the adapter pad may be stepped outward to accommodate the steps of the bearing adapter. The legs of the adapter pad may include a first vertical face extending downward from the top surface of the bearing adapter, a transition face extending outward from the first vertical face, and end sections extending downward from the transition face. Optionally, the legs of the adapter pad may be separated by a first longitudinal distance proximate to the top section, and the legs of the adapter pad may be separated by a second longitudinal distance wider than the first longitudinal distance proximate to distal ends of the legs. The second longitudinal distance may be at least 10% wider than the first longitudinal distance.

In another embodiment, a railway car truck is provided that includes a side frame for supporting a bolster. The side frame has a wide pedestal formed on longitudinally opposite ends thereof. Each pedestal has an upper jaw and a lower jaw surrounding a pedestal opening with the upper jaw having an upper jaw width and the lower jaw having a lower jaw width. The upper jaw width is wider than the lower jaw width. A bearing adapter is received in each pedestal opening for receiving a bearing. The bearing adapter has an upper jaw pocket wide enough to receive the upper jaw and lower jaw pockets wide enough to receive the lower jaw. An elastomeric adapter pad is mounted on top of the bearing adapter. The elastomeric adapter pad includes a top section defining a pad for engaging the upper jaw and depending legs defining pads for engaging the lower jaw.

Optionally, the lower jaw may be aligned vertically with the bearing to position the pedestal horizontally with respect to the bearing and the upper jaw may be positioned vertically above the bearing to position the pedestal vertically with respect to the bearing. The upper jaw width may be approximately twice the lower jaw width. The depending legs of the adapter pads may include generally flat, generally rectangular end sections that are oriented generally perpendicular to the top section. The end sections may engage outboard and inboard vertical faces of the pedestal opening. Optionally, the adapter pad may include at least two wear tabs extending laterally outwardly from a top section of the adapter pad, where each wear tab has a top face located at a height below the height of the top section, and where each of the wear tabs extends laterally outwardly beyond a lateral width of the adapter pad. The bearing adapters may include depressions extending along a top surface of the bearing adapters located inboard from longitudinal ends of the bearing adapters, and the adapter pads may include projections extending downwardly from a bottom surface of the top section of the adapter pad, where the projections are received in the depressions.

DETAILED DESCRIPTION OF THE INVENTION

Figure 2:
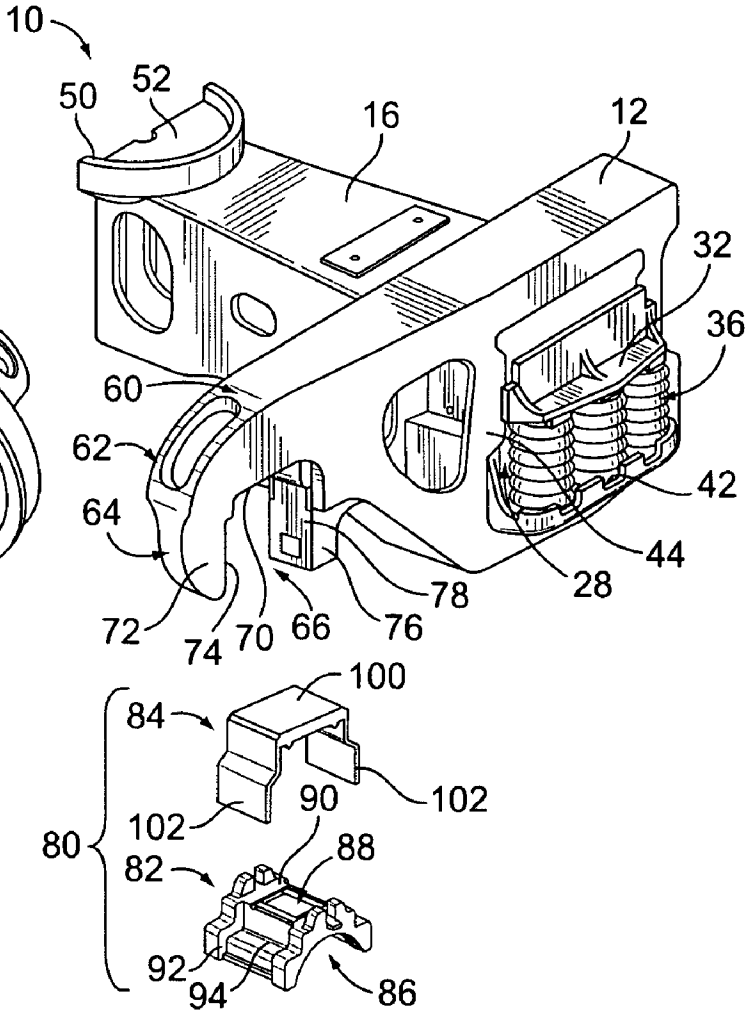
FIG. 2 is a perspective view of a portion of the railway car truck showing a bearing adapter assembly.
Figure 1:
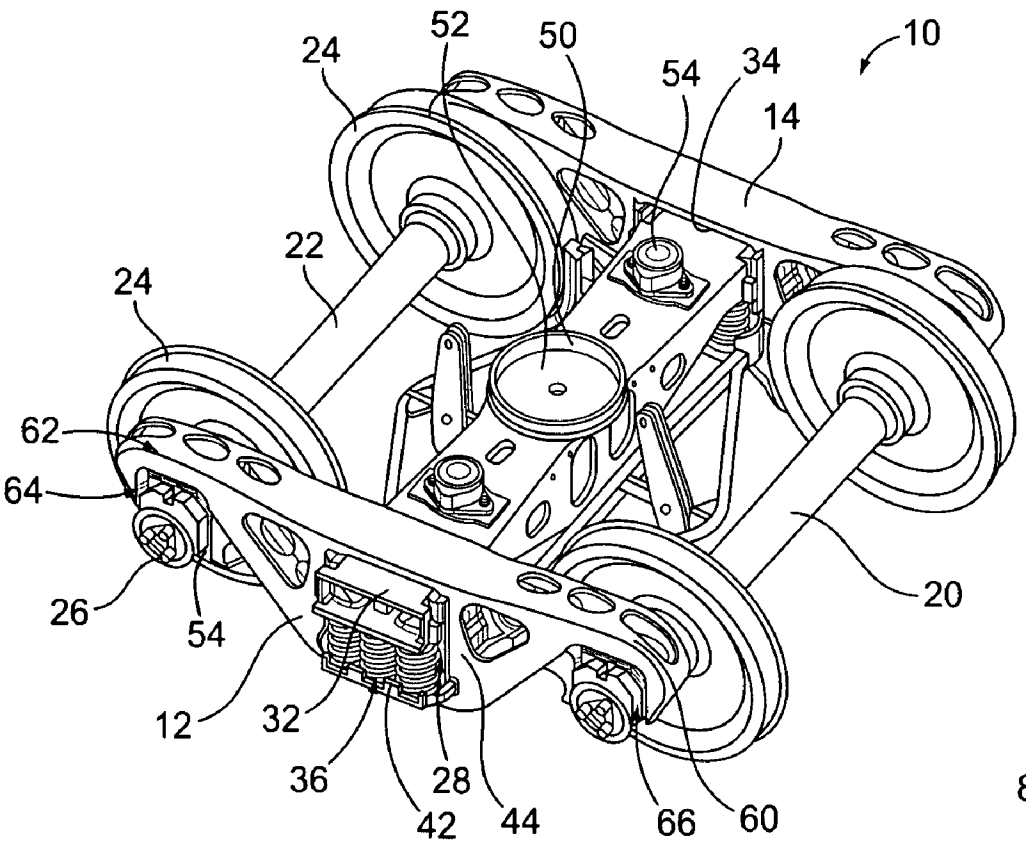
FIG. 1 illustrates a railway car truck.

Referring now to FIGS. 1 and 2, a railway car truck 10 is shown. The railway car truck 10 includes two laterally spaced side frames 12 and 14, between which a bolster 16 extends. Each of the side frames 12, 14 and bolster 16 are usually a cast steel unitary structure. Various internal ribs and supports lend strength, along with a savings in overall weight for each of such cast steel truck components.

Axles 20 and 22 extend laterally between the side frames 12, 14. Railway wheels 24 are press fit on the ends of the axles 20, 22. Roller bearing assemblies 26 are also provided on the ends of the axles 20, 22. The side frames 12, 14 include side frame openings 28 aligned with the bolster 16.

The bolster 16 is seen to include bolster ends 32 and 34, which extend through the side frame openings 28. Spring groups 36 support the bolster ends 32 on a side frame lower support 42. The side frames 12, 14 include vertical columns 44 that are longitudinally spaced and form the side frame openings 28 therebetween. The lower support section 42 has various raised structures adapted to position the spring group 36 thereupon.

The bolster 16 includes on its upper surface a bolster center plate 50, which includes a bolster center plate wear liner 52. Also included on the upper surface of the bolster 16 is a pair of laterally spaced side bearings 54.

The side frames 12, 14 are also seen to have laterally spaced pedestals 60, which are the further most lateral extent of the side frames 12, 14. Each pedestal 60 includes an upper jaw 62 and a lower jaw 64 that surround a pedestal opening 66. The pedestals 60 constitute wide pedestals having a wide pedestal opening 66, which are widened longitudinally. Such wide pedestals 60 are contrasted with narrow pedestals, which have longitudinally narrower pedestal openings. The added width on the pedestal opening 66 of the wide pedestal 60 may accommodate a longer wheel base and/or larger wheels.

The pedestal opening 66 is defined by a roof section 70 of the upper jaw 62, as well as an outer wall 72 having an outboard vertical face 74 and an inner wall 76 having an inboard vertical face 78 of the lower jaw 64. The roof section 70 is a bottom surface of the upper jaw 62. The lower jaw 64 is generally below the upper jaw 62 and includes the outer wall 72 and the inner wall 76, which are spaced apart from one another with the pedestal opening 66 therebetween. The outer wall 72 and the inner wall 76 extend downward from the upper jaw 62. In an exemplary embodiment, the upper jaw and lower jaw 62, 64 are integrally formed with one another and with the rest of the sideframe 12 or 14 as a cast steel unitary structure.

The pedestal opening 66 is adapted to receive a bearing adapter assembly 80 therein. The bearing adapter assembly 80 rests on the roller bearing assemblies 26 and defines the interface between the roller bearing assemblies 26 and the sideframes 12, 14. In the illustrated embodiment, the bearing adapter assembly 80 is used with a roller bearing assembly 26 having a 6.5×9 size arrangement. Other sized bearing adapter assemblies may be used in alternative embodiments, such as one for use with a 6.5×12 size arrangement.

The bearing adapter assembly 80 includes a bearing adapter 82 and an adapter pad 84. The bearing adapter 82 is comprised of a unitary cast steel structure, however other materials and/or forming methods or processes are possible in alternative embodiments. The bearing adapter 82 includes a concave opening 86 to receive the roller bearing assembly 26. The bearing adapter 82 includes a generally rectangular center section 88 having a top surface 90 generally opposite the concave opening 86. The bearing adapter 82 includes shoulders 92 extending downward from the center section 88 at opposite ends thereof. The bearing adapter 82 includes steps 94 extending downward from the center section 88. The steps 94 are stepped outward proximate to a bottom of the bearing adapter 82. The outward stepping increases the overall width of the bearing adapter 82 at the bottom thereof to correspond to the wide pedestal opening 66.

The adapter pad 84 is comprised of a cast or injection molded polymer or elastomer, such as a polyurethane, however other materials and/or forming methods or processes are possible in alternative embodiments. The adapter pad 84 is mounted on the top of the bearing adapter 82. The adapter pad 84 includes a generally flat, generally rectangular top section 100 and depending legs 102 that extend downwardly from each longitudinal end of the adapter pad 84. The legs 102 are stepped outward at a bottom of the legs 102. The outward stepping increases the overall width of the adapter pad 84 at the bottom thereof to correspond to the wide pedestal opening 66. The outward stepping of the adapter pad 84 mirrors the outward stepping of the steps 94 such that the adapter pad 84 fits on the bearing adapter 82. The top section 100 defines a pad for engaging the roof section 70. The depending legs 102 define pads for engaging the outboard and inboard vertical faces 74, 78.

The adapter pad 84 protects the side frame pedestal jaw from wear. Additionally, the adapter pad 84 takes up longitudinal clearance between the bearing adapter 82 and the pedestal 60. For example, the adapter pad 84 allows a snug fit of the bearing adapter assembly 80 within the pedestal opening 66. The adapter pad 84 allows the buildup of stored energy during railway car curving resulting from pad deflection, such as through compression of the legs 102 and/or shear of the top section 100. Curving refers to the situation when the wheel sets take the necessary radial position (normally parallel axles develop an angle between them) during movement down the railway track, such as along a curved section of the railway track, which may occur through a combination of longitudinal and lateral axle translation. The adapter pad 84 stores the energy and helps the wheel set return to a proper position after curving by releasing the stored energy when the car exits the curve. The adapter pad 84 provides a centering mechanism to keep the axles parallel on straight track. The adapter pad 84 may attenuate vertical wheel impacts. The adapter pad 84 may improves bearing load distribution to help extend bearing component life.

Figure 3:
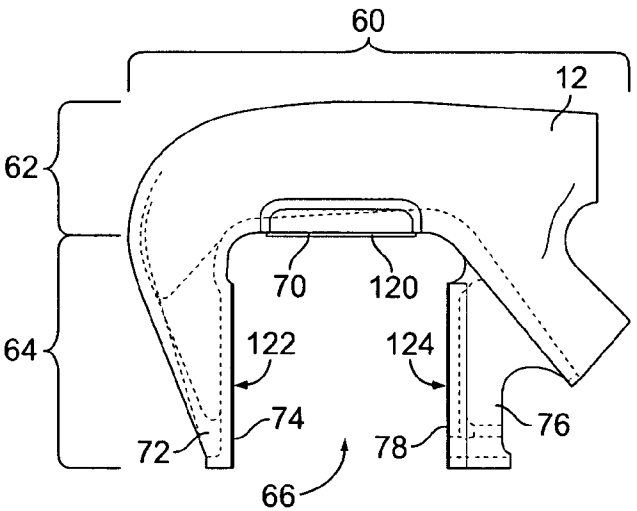
FIG. 3 is a side view of a portion of a side frame of the railway car truck shown in FIG. 1.
Figure 4:
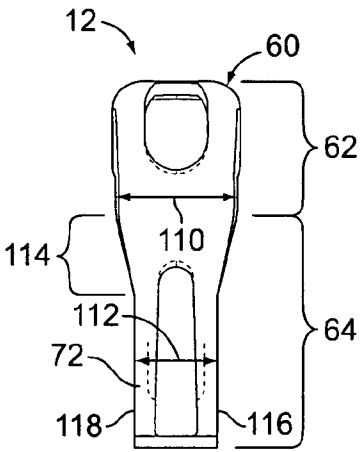
FIG. 4 is an end view of a portion of the side frame with a wear plate.
Figure 5:
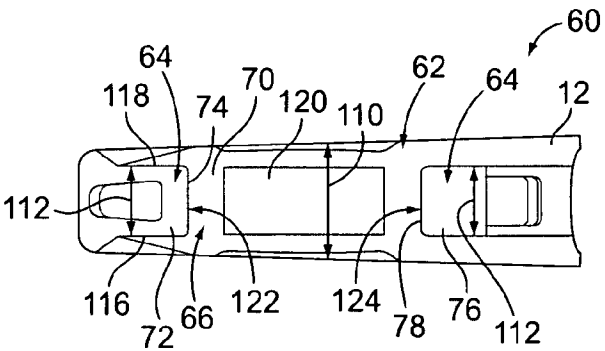
FIG. 5 is a bottom view of a portion of the side frame.

Referring now to FIGS. 3-5, the pedestal 60 of one end of the sideframe 12 is shown. The pedestal 60 includes the upper jaw 62 and the lower jaw 64. As shown in FIG. 5, the upper jaw 62 is wider laterally than the lower jaw 64. The added width on the upper jaw 62 provides additional support and strength for the pedestal 60. The added width on the upper jaw 62 provides additional protection or shielding over the lower jaw 64. In the illustrated embodiment, the upper jaw 62 is approximately twice as wide as the lower jaw 64. For example, the upper jaw 62 has an upper jaw width 110, while the lower jaw 64 has a lower jaw width 112. Optionally, the lower jaw 64 may include a transition portion 114 having a variable width that transitions between the upper jaw width 110 and the lower jaw width 112.

The pedestal opening 66 is situated between the upper and lower jaws 62, 64. The pedestal opening 66 is bounded by the roof section 70 at the top and the outboard and inboard vertical faces 74, 78 at the sides. The pedestal opening 66 is open at the bottom for receiving the roller bearing assembly 26 (shown in FIGS. 1-2). As shown in FIG. 4, the roof section 70 is wider laterally than the outboard and inboard vertical faces 74, 78. The upper jaw 62 hangs over lateral sides 116, 118 of the outer and inner walls 72, 76, respectively. When the bearing adapter assembly 80 (shown in FIGS. 1-2) is loaded into the pedestal opening 66, the bearing adapter assembly 80 needs to be wide enough to accommodate the roof section 70 and the upper jaw 62. In an exemplary embodiment, the roof section 70 includes a pedestal roof liner 120, which represents a bearing surface of the pedestal 60. The pedestal roof liner 120 may be narrower than the roof section 70 and/or the upper jaw 62. Optionally, the pedestal roof liner 120 may have a width that is approximately equal to the width of the lower jaw 64.

The pedestal 60 includes an outer thrust lug 122 and an inner thrust lug 124 along the outboard vertical face 74 and the inboard vertical face 78, respectively. The outer and inner thrust lugs 122, 124 represent bearing surfaces of the pedestal 60. Optionally, the outer and inner thrust lugs 122, 124 may be parallel to one another and generally perpendicular with respect to the roof liner 120. As shown in FIG. 3, the outer thrust lug 122 may be positioned away from the roof section 70. Alternatively, the outer thrust lug 122 may be positioned at the intersection of the outboard vertical face 74 and the roof section 70. The outer thrust lug 122 may be angled between the outboard vertical face 74 and the roof section 70. The inner thrust lug 124 may be positioned away from the roof section 70. Alternatively, the inner thrust lug 124 may be positioned at the intersection of the inboard vertical face 78 and the roof section 70. The inner thrust lug 124 may be angled between the outboard vertical face 74 and the roof section 70.

Figure 6:
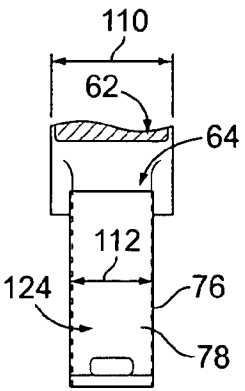
FIG. 6 is a partial sectional view of a portion of the side frame taken along line 6-6 in FIG. 2.

FIG. 6 shows the inner wall 76 of the lower jaw 64. The inner thrust lug 124 is arranged along the inboard vertical face 78. At the top of the inner wall 76, the lower jaw 64 transitions into the upper jaw 62. The widths 110, 112 of the upper jaw 62 and lower jaw 64, respectively, can be seen in FIG. 6. When the bearing adapter assembly 80 (shown in FIGS. 1-2) is loaded into the pedestal opening 66, the bearing adapter assembly 80 needs to be laterally wide enough to accommodate the upper jaw 62 and longitudinally wide enough to snuggly fit between the outer and inner walls 72, 76.

Figure 8:
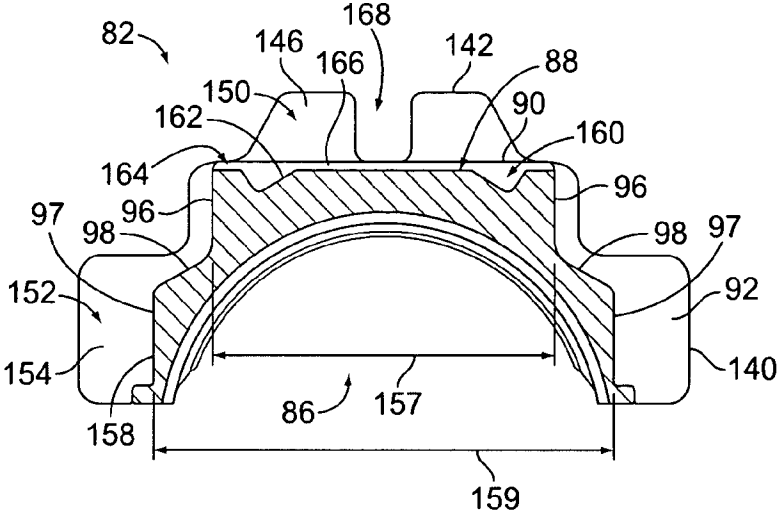
FIG. 8 is a sectional view of the bearing adapter taken along line 8-8 in FIG. 7.
Figure 9:
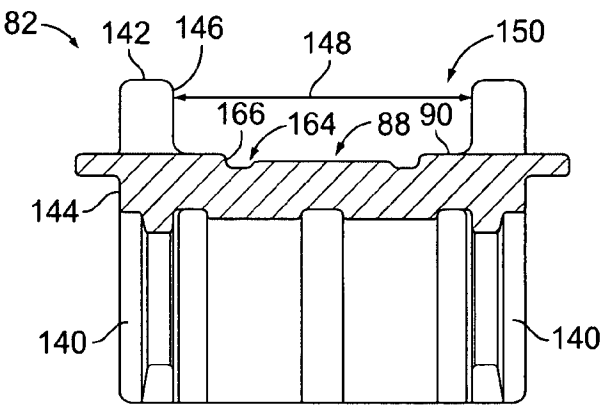
FIG. 9 is a sectional view of the bearing adapter taken along line 9-9 in FIG. 7.
Figure 7:
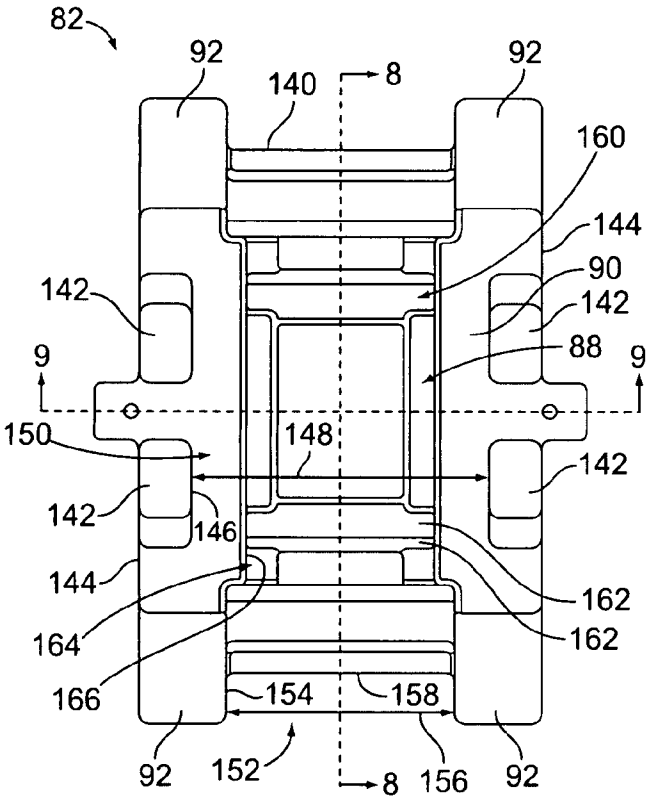
FIG. 7 is a top view of a bearing adapter for the bearing adapter assembly shown in FIG. 1.

With reference to FIGS. 7-9, the bearing adapter 82 is shown. The bearing adapter 82 is seen to be comprised of a unitary, cast steel structure that is generally rectangular in shape having the center section 88 defining the top surface 90 and depending legs 140 extending therefrom.

The top surface 90 is generally flat. Two raised edge supports 142 extend upwardly from both lateral edges 144 of the center section 88. Any number of edge supports 142 may be provided in alternative embodiments. The edge supports 142 include inner surfaces 146 that are spaced laterally across from one another by a distance 148. An upper jaw pocket 150 is defined between the edge supports 142 generally vertically above the top surface 90. The upper jaw pocket 150 receives the upper jaw 62 (shown in FIG. 5) when the bearing adapter assembly 80 is mounted to the sideframe 12. The upper jaw pocket 150 has a width defined by the distance 148. The width of the upper jaw pocket 150 corresponds to the upper jaw width 110 (shown in FIG. 5) to accommodate the upper jaw 62. The edge supports 142 are spaced apart far enough to accommodate the upper jaw 62. Optionally, the edge supports 142 may engage the lateral sides of the upper jaw 62 to maintain a lateral position of the bearing adapter 82 with respect to the upper jaw 62. Alternatively, the edge supports 142 may be spaced apart such that clearance is provided between the inner surfaces 146 and the upper jaw 62.

The legs 140 extend downward and define the concave openings 86 on each lower lateral edge thereof to receive and seat against the roller bearing assembly 26 (shown in FIGS. 1-2). The legs 140 define the steps 94 at the outer portions thereof. Any number of steps may be provided. In the illustrated embodiment, the legs 140 define two steps, represented by a first, or inner, step 96 and a second, or outer, step 97. A transition 98 extends between the inner and outer steps 96, 97. The inner and outer steps 96, 97 constitute generally vertical portions or surfaces. Optionally, the inner and outer steps 96, 97 may be angled such that the inner and outer steps 96, 97 are not completely vertical, as in the illustrated embodiment. The transition 98 constitutes a generally horizontal portion or surface. Optionally, the transition 98 may be angled such that the transition 98 is more horizontal than vertical. Alternatively, the transition 98 may be angled such that the transition 98 is more vertical than horizontal. In the illustrated embodiment, the transition 98 is approximately at a 35° angle. The outward stepping increases the overall width of the bearing adapter 82 at the bottom thereof to correspond to the wide pedestal opening 66.

The shoulders 92 extend from the legs 140 beyond the steps 94. Optionally, four shoulders 92 may be provided generally at the four corners of the bearing adapter 82, however any number of shoulders 92 may be provided in alternative embodiments. The shoulders 92 at each longitudinal end of the bearing adapter 82 are laterally spaced from one another, forming lower jaw pockets 152 for receiving the adapter pad 84 and the lower jaw 64 (shown in FIG. 5). The shoulders 92 include inner surfaces 154 that are spaced laterally across from one another by a distance 156.

An end surface 158 of the bearing adapter 82 is defined between the shoulders 92. The end surface 158 is defined by the inner and outer steps 96, 97 as well as the transition 98. The end surface 158 is contoured and includes flat, vertical sections (e.g. the inner and outer steps 96, 97) and an angled section (e.g. the transition 98) between the flat, vertical sections. The end surfaces 158 of the legs 140 are separated by a first longitudinal distance 157 proximate to the top section 90. The end surfaces 158 of the legs 140 are separated by a second longitudinal distance 159 wider than the first longitudinal distance 157 proximate to distal ends of the legs 140. The first longitudinal distance 157 is the distance separating the inner steps 96 and the second longitudinal distance 159 is the distance separating the outer steps 97. The bearing adapter 82 is wider at the outer steps 97 than the inner steps 96 to correspond to the wide pedestal opening 66. Optionally, the second longitudinal distance 159 is at least 10% wider than the first longitudinal distance 157.

The lower jaw pocket 152 is defined between the shoulders 92 generally horizontally outward of the end surface 158. The lower jaw pocket 152 has a width defined by the distance 156. In an exemplary embodiment, the distance 156 is less than the distance 148 such that the lower jaw pocket 152 is narrower than the upper jaw pocket 150. The width of the lower jaw pocket 152 corresponds to the lower jaw width 112 (shown in FIG. 5) to accommodate the lower jaw 64. The shoulders 92 are spaced apart far enough to accommodate the lower jaw 64. Optionally, the shoulders 92 may engage the lateral sides of the lower jaw 64 to maintain a lateral position of the bearing adapter 82 with respect to the lower jaw 64. Alternatively, the shoulders 92 may be spaced apart such that clearance is provided between the inner surfaces 154 and the lower jaw 64. Optionally, a portion of the adapter pad 84 may be provided between the inner surfaces 154 of the shoulders 92 and the lower jaw 64 to define thrust bearing surfaces.

Depressions 160 are provided in the center section 88 of the bearing adapter 82. The depressions 160 are spaced longitudinally and extend laterally across the center section 88. Each depression 160 includes wall sections 162 that extend downwardly from top surface 90 at acute angles therefrom. One or more of the wall sections 162 may extend perpendicular from the top surface 90 in alternative embodiments. The depressions 160 form channels that receive the adapter pad 84 to position the adapter pad 84 relative to the bearing adapter 82. The channels may be of a general V-shape, formed by acute angle wall sections 162 into the center section 88, or the channels could be of an arcuate nature.

The bearing adapter 82 includes a recessed channel 164 in the center section 88 that receives the adapter pad 84 (shown in FIG. 2). The recessed channel 164 includes side surfaces 166 at lateral edges of the recessed channel 164. The side surfaces 166 are spaced apart from one another by a distance corresponding to a width of the adapter pad 84, such that the adapter pad 84 engages the side surfaces 166 and the side surfaces 166 hold the lateral position of the adapter pad 84 within the bearing adapter 82. In an exemplary embodiment, the recessed channel 164 has a depth that is less than a thickness of the adapter pad 84. As such, a top portion of the adapter pad 84 is positioned above the top surface 90.

A window 168 is provided between the edge supports 142. The window 168 provides visual access to the upper jaw pocket 150, such as for visual inspection of the adapter pad 84 and/or the upper jaw 62 within the upper jaw pocket 150. The portion of the adapter pad 84 that extends out of the recessed channel 164 above the top surface 90 is visible through the window 168. As such, wear of the adapter pad 84 may be seen upon inspection of the window 168.

Figure 10:
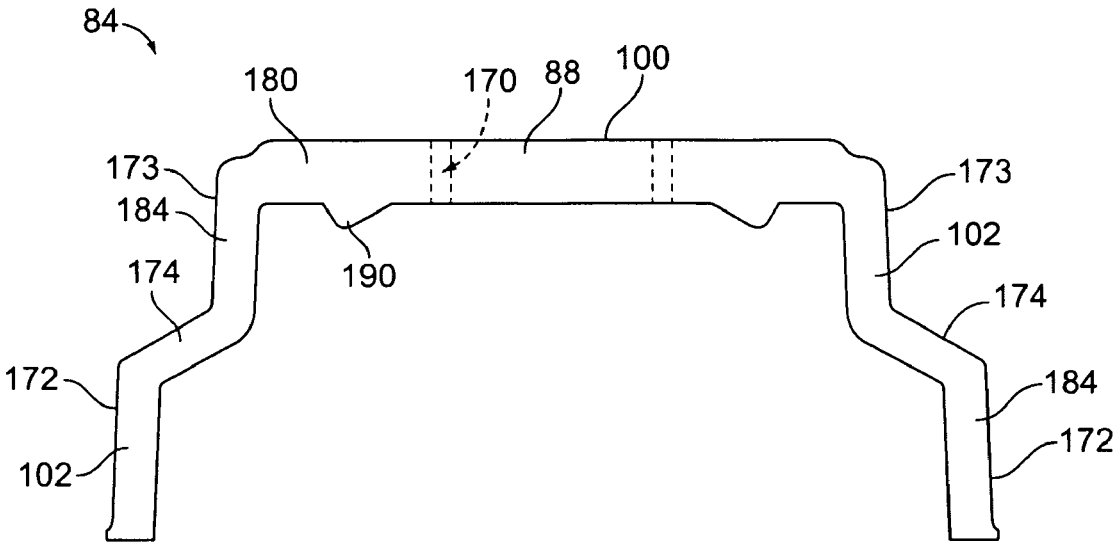
FIG. 10 is a side view of an adapter pad for the bearing adapter assembly shown in FIG. 1.

FIG. 10 is a side view of the adapter pad 84. The adapter pad 84 is comprised of a cast polymer or elastomeric material and is of unitary structure. Alternatively, the adapter pad 84 may be constructed using a blown injection method or another method or process. Other materials may be used in alternative embodiments, including other synthetic or metal materials. The adapter pad 84 may be manufactured from a material selected to have a lower coefficient of friction than the bearing adapter 82, which may be a cast steel piece. All-metal adapters have a tendency to stick due to friction, sometimes orienting the axles in a less than desirable position such that wheel flanges can scrub and wear against the rail, whether in a curve or on straight track. Having the adapter pad 84 manufactured from a material other than an all metal material may lower the amount of friction between the bearing adapter assembly 80 and the pedestal 60, alleviating the problem of improperly orienting the axles and/or wheel flanges. The adapter pad 84 may be manufactured from a material having a durometer hardness between 90A and 58D.

The adapter pad 84 includes the generally flat, generally rectangular top section 100 and the depending legs 102 that extend downwardly from each longitudinal end of the adapter pad 84. The top section 100 defines a bearing surface or wear plate for the upper jaw 62 (shown in FIG. 5). In an exemplary embodiment, the top section 100 includes holes 170 that are configured to receive grounding pins therein that extend entirely through the top section 100. The grounding pins define a grounding path between the roller bearing assembly 26 and the sideframe 12.

The legs 102 include generally flat, generally rectangular end sections 172 that are oriented generally perpendicular to the top section 100. The end sections 172 are configured to engage the outboard and inboard vertical faces 74, 78 (shown in FIG. 3). The end sections 172 of the depending legs 102 define bearing surfaces or wear plates for the lower jaw 64. Optionally, the legs 102 may include vertical faces 173 extending downward from the top section 100 and transition sections 174 extending outward from the vertical faces 173. The end sections 172 extend downward from the transition sections 174. The transition sections 174 may have one or more angled surfaces that transition between the vertical faces 173 and the end sections 172. Optionally, the transition sections 174 may be substantially horizontal. The size and shape of the legs 102 may mirror the size and shape of the lets 140 of the bearing adapter 82 such that the adapter pad 84 may fit over the bearing adapter 82.

Figure 11:
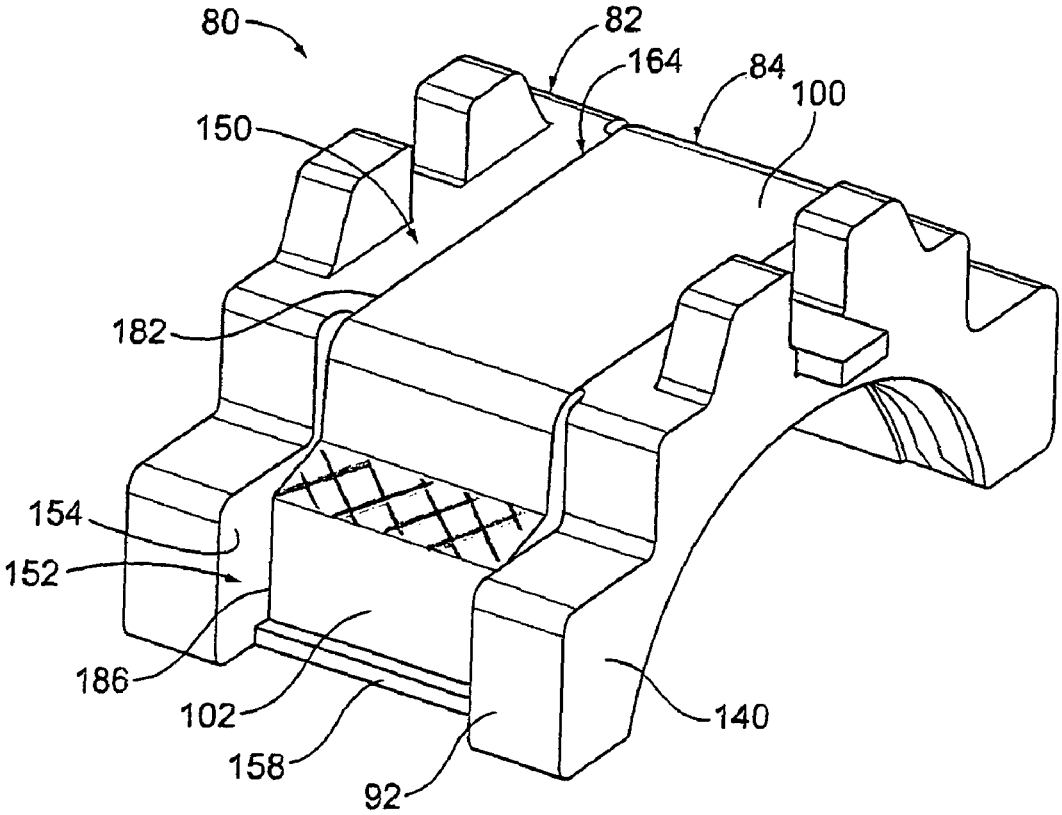
FIG. 11 is a perspective view of the bearing adapter assembly in an assembled state.

The top section 100 includes lateral edges 180, 182 (shown in FIG. 11) and the depending legs 102 include lateral edges 184, 186 (shown in FIG. 11). Optionally, the lateral edges 180 of the top section 100 and the lateral edges 184 of the depending legs 102 may be aligned with one another in a coplanar relationship. Similarly, the lateral edges 182 of the top section 100 and the lateral edges 186 of the depending legs 102 may be aligned with one another in a coplanar relationship. As such, the top section 100 and the legs 102 have generally equal widths. In alternative embodiments, the lateral edges 180 and 184 or 182 and 186 may be offset such that either the top section 100 or the legs 102 are wider.

The adapter pad 84 includes depending protrusions 190 that extend downwardly from the bottom surface of the top section 100. The protrusions 190 extend laterally across the width of the adapter pad 84, extending to, or nearly to, the lateral edges 180, 182. The protrusions 190 are designed to be fit into the depressions 160 (shown in FIG. 9) of the bearing adapter 82. Such fitting provides lateral and longitudinal stability for the adapter pad 84 when fit against the bearing adapter 82. The protrusions 190 may be of a general V-shape, formed by two wall sections extending downwardly at an acute angle from the lower surface of the top section 100. Alternatively, the protrusions 190 could be of an arcuate nature, extending into complementary arcuate depressions in the center section 88 of the bearing adapter 82.

Figure 12:
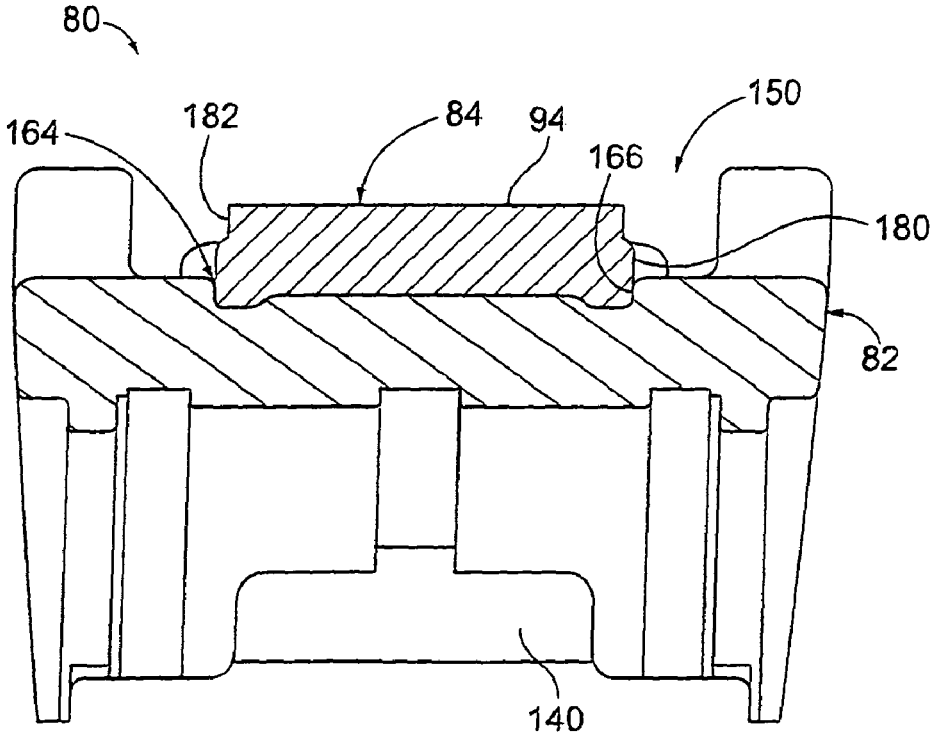
FIG. 12 is a cross-sectional view of the bearing adapter assembly.

FIGS. 11 and 12 illustrate the bearing adapter assembly 80 in an assembled state. The adapter pad 84 is mounted to a top of the bearing adapter 82. The top section 100 is loaded through the upper jaw pocket 150 into the recessed channel 164. The lateral edges 180, 182 engage the side surfaces 166 to hold the lateral position of the adapter pad 84 with respect to the bearing adapter 82. Lateral stability is provided with the edges 180, 182 of the adapter pad 84 abutting the side surfaces 166 of the bearing adapter 82.

The legs 102 of the adapter pad 84 generally follow the contour of the legs 140 along the end surface 158. The legs 102 abut against the end surface 158, which provides a stable base for the legs 102 of the adapter pad 84. The legs 102 are positioned between the shoulders 92. Optionally, the lateral edges 184, 186 of the legs 102 may be spaced apart from the inner surfaces 154 of the shoulders 92. Alternatively, the lateral edges 184, 186 may engage the inner surfaces 154, such that the shoulders 92 help maintain the lateral position of the adapter pad 84 within the lower jaw pocket 152. The legs 102 of the adapter pad 84 and the legs 140 of the bearing adapter 82 are stepped outward to increase the width at the bottom of the bearing adapter assembly 80. The increased width allows the bearing adapter assembly 80 to fit within the wide pedestal opening 66.

When assembled, the protrusions 190 of the adapter pad 84 are received in the depressions 160 of the bearing adapter 82, which, in addition to the interface between the lateral edges 180, 182 and the side surfaces 166, function as an interlock to hold the adapter pad 84 with respect to the bearing adapter 82. Such interlock allows the adapter pad 84 to function in shear. With the proper relationship between cross section and hardness of the adapter pad 84, a spring rate is designed into the elastomer material of the adapter pad 84. The elastomer adapter pad 84 allows the railway truck wheel-sets to move from a high warp stiffness position to that of a radial steering position when the truck passes through curves. Once through the curve the elastomer adapter pad 84 acts as a spring to re-center the bearing adapter assembly 80 to a neutral position.

Figure 13:
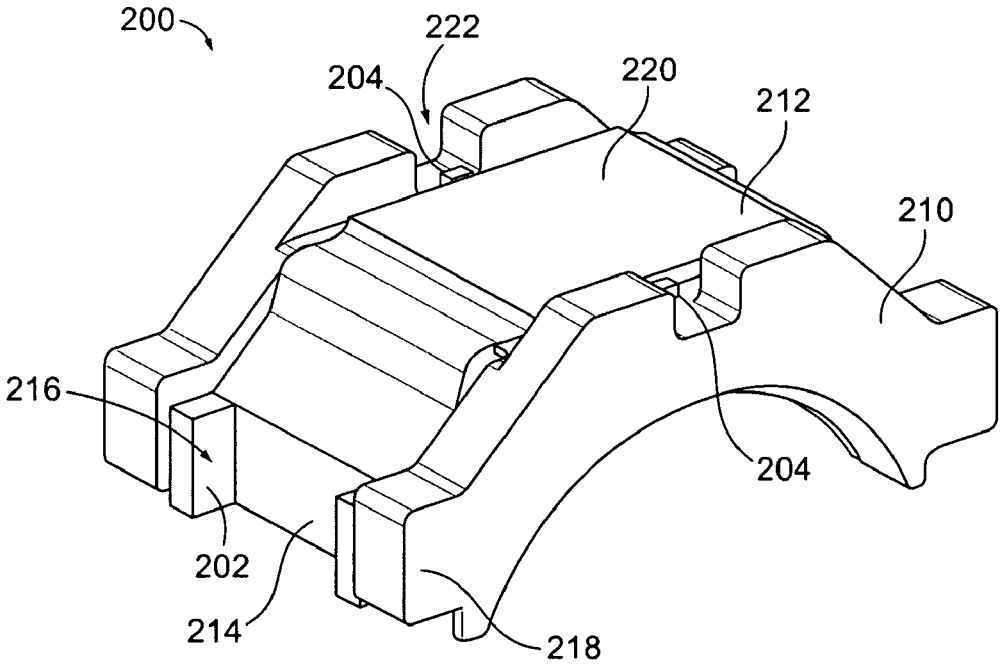
FIG. 13 is a perspective view of an alternative bearing adapter assembly.

FIG. 13 is a perspective view of an alternative bearing adapter assembly 200. The bearing adapter assembly 200 is similar to the bearing adapter assembly 80 in many respects, however the bearing adapter assembly 200 includes thrust pads 202 and wear tabs 204.

The bearing adapter assembly 200 includes a bearing adapter 210 and an adapter pad 212. The bearing adapter 210 may be similar to the bearing adapter 82. The adapter pad 212 may be similar to the adapter pad 84, however the adapter pad 212 includes the thrust pads 202 extending from legs 214 of the adapter pad 212. The legs 214 are stepped outward to increase the width at the bottom of the bearing adapter assembly 200. The increased width allows the bearing adapter assembly 200 to fit within the wide pedestal opening 66.

The thrust pads 202 form a thrust lug opening 216 there between. A similar thrust lug opening is formed on the other longitudinal end of the adapter pad 212. When the adapter pad 212 is assembled onto the top of the bearing adapter 210, the thrust pads 202 project outwardly from the legs 214 and are supported laterally against depending shoulders 218 of the bearing adapter 210. When received in the pedestal opening 66, the outer and inner thrust lugs 122, 124 are received in the thrust lug openings 216. The thrust pads 202 bear against the lateral sides of the outer and inner thrust lugs 122, 124.

The wear tabs 204 extend laterally outwardly from a center section 220 of the adapter pad 212. The top face of each wear tab 204 is seen to be at a height below that of a top of the center section 220. The reason for this is that upon installation, the top of the center section 220 wears due to contact with the roof section 70 of the pedestal 60. When the center section 220 is worn to the design limit for replacement, the roof section 70 of the pedestal 60 will be just contacting the top face of the wear tabs 204. The wear tabs 204 provide a ready indication of when the adapter pad 212 is worn to the point that the adapter pad 212 should be replaced. Windows 222 are provided to allow visual inspection of the wear tabs 204. The wear tabs 204 are aligned with the windows 222.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A railway car truck comprising a bolster having laterally opposite ends;

two side frames transverse to the bolster and supporting the opposite ends of the bolster, each side frame having a wide pedestal formed on longitudinally opposite ends thereof, each pedestal having an upper jaw and a lower jaw surrounding a pedestal opening, the upper jaw having a roof section above the pedestal opening, the lower jaw having an inner wall and an outer wall on opposite sides of the pedestal opening, the inner and outer walls being spaced apart from one another to define a wide pedestal opening;

a bearing adapter received in each pedestal opening, each bearing adapter comprising a concave opening to receive a bearing and a generally rectangular center section having a top surface generally opposite the concave opening, the bearing adapter comprising edge supports extending from the top surface, the edge supports defining an upper jaw pocket therebetween, the upper jaw pocket receiving the upper jaw, the bearing adapter comprising adapter shoulders at opposite ends of the bearing adapter, the shoulders defining lower jaw pockets at the opposite ends, the lower jaw pocket receiving the lower jaw, the bearing adapter having steps extending outward from sides thereof, the steps having outer surfaces separated by a distance corresponding to the width of the pedestal opening; and an elastomeric adapter pad mounted on top of the bearing adapter, the adapter pad comprising a generally flat, generally rectangular top section and depending legs that extend along the outer surfaces steps, the top section defining a pad for engaging the roof section, the depending legs defining pads for engaging the inner and outer walls, wherein the sides of the bearing adapter each include an inner step extending downward from the top surface of the bearing adapter and a transition extending outward from the inner step to an outer step, the outer step having a substantially vertical face extending downward from the transition, the outer step defining the outer surface of the bearing adapter.

2. The railway car truck of claim 1, wherein the steps are stepped outward at a lower portion thereof to provide additional width for the bearing adapter.

3. The railway car truck of claim 1, wherein the legs of the adapter pad are stepped outward to accommodate the steps of the bearing adapter.

4. The railway car truck of claim 1, wherein the legs of the adapter pad include a first vertical face extending downward from the top surface of the bearing adapter, a transition face extending outward from the first vertical face, and end sections extending downward from the transition face, the end sections defining the pads for engaging the inner and outer walls.

5. The railway car truck of claim 1, wherein the legs of the adapter pad are separated by a first longitudinal distance proximate to the top section, and wherein the legs of the adapter pad are separated by a second longitudinal distance wider than the first longitudinal distance proximate to distal ends of the legs.

6. The railway car truck of claim 5, wherein the second longitudinal distance is at least 10% wider than the first longitudinal distance.

7. The railway car truck of claim 1, wherein the depending legs of the adapter pads include generally flat, generally rectangular end sections that are oriented generally perpendicular to the top section, the end sections engaging inner and outer walls.

8. The railway car truck of claim 1, wherein the adapter pad further comprises at least two wear tabs extending laterally outwardly from the top section, each wear tab having a top face located at a height below the height of the top section, each of the wear tabs extends laterally outwardly beyond the lateral width of the adapter pad.

9. The railway car truck of claim 1, wherein the bearing adapters include depressions extending along the top surface located inboard from the longitudinal end sections, the adapter pads including projections extending downwardly from a bottom surface of the top section of the adapter pad, wherein the projections are received in the depressions.

10. A railway car truck comprising a bolster having laterally opposite ends;

two side frames transverse to the bolster and supporting the opposite ends of the bolster, each side frame having a wide pedestal formed on longitudinally opposite ends thereof, each pedestal having an upper jaw and a lower jaw surrounding a pedestal opening, the upper jaw having a roof section above the pedestal opening, the lower jaw having an inner wall and an outer wall on opposite sides of the pedestal opening, the inner and outer walls being spaced apart from one another to define a wide pedestal opening;

a bearing adapter received in each pedestal opening, each bearing adapter comprising a concave opening to receive a bearing and a generally rectangular center section having a top surface generally opposite the concave opening, the bearing adapter comprising edge supports extending from the top surface, the edge supports defining an upper jaw pocket therebetween, the upper jaw pocket receiving the upper jaw, the bearing adapter having steps extending outward from sides thereof, the steps having outer surfaces separated by a distance corresponding to the width of the pedestal opening;

an elastomeric adapter pad mounted on top of the bearing adapter, the adapter pad comprising a generally flat, generally rectangular top section and depending legs that extend along the outer surfaces of the steps, the top section defining a pad for engaging the roof section, the depending legs defining pads for engaging the inner and outer walls, and the adapter pad further comprises at least two wear tabs extending laterally outwardly from the top section, each wear tab having a top face located at a height below the height of the top section, wherein the sides of the bearing adapter each include an inner step extending downward from the top surface of the bearing adapter and a transition extending outward from the inner step to an outer step, the outer step having a substantially vertical face extending downward from the transition, the outer step defining the outer surface of the bearing adapter.

11. The railway car truck of claim 10, wherein the steps are stepped outward at a lower portion thereof to provide additional width for the bearing adapter.

12. The railway car truck of claim 10, wherein the legs of the adapter pad are stepped outward to accommodate the steps of the bearing adapter.

13. The railway car truck of claim 10, wherein the legs of the adapter pad include a first vertical face extending downward from the top surface of the bearing adapter, a transition face extending outward from the first vertical face, and end sections extending downward from the transition face, the end sections defining the pads for engaging the inner and outer walls.

14. The railway car truck of claim 10, wherein the legs of the adapter pad are separated by a first longitudinal distance proximate to the top section, and wherein the legs of the adapter pad are separated by a second longitudinal distance wider than the first longitudinal distance proximate to distal ends of the legs.

15. The railway car truck of claim 14, wherein the second longitudinal distance is at least 10% wider than the first longitudinal distance.

16. The railway car truck of claim 10, wherein the depending legs of the adapter pads include generally flat, generally rectangular end sections that are oriented generally perpendicular to the top section, the end sections engaging inner and outer walls.

17. The railway car truck of claim 10, wherein the bearing adapter comprises adapter shoulders at opposite ends of the bearing adapter, the shoulders defining lower jaw pockets at the opposite ends, the lower jaw pocket receiving the inner and outer walls of the lower jaw.

18. The railway car truck of claim 10, wherein the bearing adapters include depressions extending along the top surface located inboard from the longitudinal end sections, the adapter pads including projections extending downwardly from a bottom surface of the top section of the adapter pad, wherein the projections are received in the depressions.

* * * * *